US007154406B1

(12) United States Patent
Judge

(10) Patent No.: US 7,154,406 B1
(45) Date of Patent: Dec. 26, 2006

(54) POWER TOOL LEVEL INDICATOR

(75) Inventor: Alfred H. Judge, Jarrettsville, MD (US)

(73) Assignee: Black & Decker Inc., Newark, DE (US)

( * ) Notice: Subject to any disclaimer, the term of this patent is extended or adjusted under 35 U.S.C. 154(b) by 472 days.

(21) Appl. No.: 09/636,272

(22) Filed: Aug. 10, 2000

(51) Int. Cl.
*G08B 21/00* (2006.01)

(52) U.S. Cl. ..... 340/686.1; 340/686.2; 340/686.3; 340/686.5; 340/689; 33/334; 200/61.45 T; 200/61.51

(58) Field of Classification Search ..... 340/686.1, 340/689, 686.2, 686.5, 686.3; 33/333, 334, 33/373; 200/61.45 R, 61.46, 61.51, 61.52
See application file for complete search history.

(56) References Cited

U.S. PATENT DOCUMENTS

| | | | | |
|---|---|---|---|---|
| 3,233,235 | A | 2/1966 | Wright | |
| 3,584,387 | A | 6/1971 | Sturm | |
| 4,141,151 | A * | 2/1979 | Jansky | 33/334 |
| 4,253,242 | A | 3/1981 | McInerney | |
| 4,295,279 | A | 10/1981 | Sienknecht | |
| 4,703,315 | A * | 10/1987 | Bein et al. | 340/686.1 |
| 4,922,620 | A | 5/1990 | Terragni | |
| 4,972,595 | A | 11/1990 | Shimamura et al. | |
| 5,046,261 | A | 9/1991 | Scott | |
| 5,159,761 | A | 11/1992 | Cagan et al. | |
| 5,365,671 | A | 11/1994 | Yaniger | |
| 5,767,467 | A * | 6/1998 | Grant | 200/61.51 |
| 6,694,631 | B1 * | 2/2004 | Bone et al. | 33/333 |

FOREIGN PATENT DOCUMENTS

| | | |
|---|---|---|
| AT | 396 528 B | 10/1993 |
| AU | 0 578 209 | 9/1988 |
| DE | 92 05 302.5 | 8/1993 |
| DE | 198 51 562 A1 | 5/2000 |
| FR | 2 761 466 | 10/1998 |

* cited by examiner

*Primary Examiner*—Julie Lieu
(74) *Attorney, Agent, or Firm*—Hanress, Dickey & Pierce, P.L.C.

(57) ABSTRACT

A power tool includes a leveling mechanism that determines horizontal or vertical planes of the power tool. The leveling mechanism has a housing with a cavity in the housing. A rotating member is in the housing. The rotating member moves in the cavity such that the rotating members seeks an equilibrium position. The equilibrium position corresponds to a horizontal or vertical plane. Electrical contacts are coupled with the rotating member such that the electrical contacts only complete an electrical circuit when the rotating member is in the equilibrium position. An indicator is electrically coupled with the electrical contacts to indicate to the user when the mechanism is in an equilibrium position. A power source is coupled with the electrical contacts and the indicator to energize the indicator when the circuit is complete.

13 Claims, 3 Drawing Sheets

POWER TOOL LEVEL INDICATOR

BACKGROUND AND SUMMARY OF THE INVENTION

The present invention relates to power tools and, more particularly, to a leveling device that indicates when the power tool is in a horizontal or vertical plane.

In various types of power tools, especially drilling tools, it is desirable to know when the tool is in a horizontal or vertical plane. This is particularly useful when drilling holes for hanging doors or the like when it is desirable to have holes which are in plane with horizontal.

Bubble type of levels have been utilized in power tools. However, these types of leveling devices have various shortcomings. While the bubble level works satisfactorily for horizontal applications, it is still burdensome on the user to view the bubble in between the lines. Ordinarily, these bubble types of levels are not conducive for vertical drilling. Also, due to the vibration of the tool, frothing occurs inside the level, rendering the bubble level useless in many applications.

Another type of measuring device utilizes a simple pendulum with a rigid straight bar connecting the pivot point with a hanging weight together with a cross bar mounted at ninety (90°) degrees to a vertical bar. The cross bar can be disposed on either side of the pivot point when the pivot level is hung and the weight achieves equilibrium, the cross bar will be positioned in a horizontal plane. Accordingly, the ends may be aligned with two notches on a carrier board to align the board to the horizontal and thus measure the horizontal plane.

Both of these devices require the user to get an accurate view during drilling to maintain the plane of the power tool. Also, while these types of devices may be satisfactory for horizontal planes, they are not particularly useful when used in a vertical drilling arrangement.

Accordingly, it is an object of the present invention to provide a user with an easy to use leveling device. The device indicates to the user, usually by an illuminated light, that horizontal or vertical planes have been achieved. The present invention enables the user to readily establish visual contact to indicate that a desired plane has been achieved.

According to a first embodiment of the present invention, a mechanism for determining if a power tool is in a horizontal or vertical plane comprises a housing with a cavity in the housing. A rotating member is positioned within the housing. The rotating member moves in the cavity such that the rotating member seeks an equilibrium position which corresponds to a horizontal or vertical plane. Electrical contacts are coupled with the rotating member such that the electrical contacts only complete an electrical circuit when the rotating member is in the equilibrium position. An indicator is electrically coupled with the electrical contacts to indicate to the user when the mechanism is in an equilibrium position. A power source is electrically coupled with the electrical contacts and the indicator to energize the indicator when the circuit is complete. The rotating member may be fixed for rotation about a central axis in a cylindrical cavity in the housing. Here, the rotating member includes a biased electrical contact. The electrical contacts include a pair of annular members coupled with the housing. Each annular member includes electrical contact portions spaced ninety (90°) degrees from one another. Thus, as the rotating member reaches the equilibrium position, the rotating members biased electrical member contacts the annular ring electrical contact portions to complete the circuit and activating the indicator. Alternatively, the rotating member could be manufactured from an electrical conductive material. Here, the rotating member is cylindrical and has at least one projecting member. The electrical contacts include a biased member to electrically contact the at least one projecting member when the cylindrical rotating member is in the equilibrium position. An axle projects through the cylindrical rotating member to complete the circuit. Alternatively, the cavity may be defined by a pair of opposing conductive conical members acting as the electrical contacts. Here, the rotating member includes a pair of conductive balls. The opposing conductive cylindrical members are separated by a non-conductive membrane. The membrane includes apertures positioned at ninety (90°) degrees apart from one another about a circle. The balls contact one another through the apertures in the membrane when the balls are in the equilibrium position to complete the circuit and activate the indicator.

In accordance with a second embodiment of the present invention, a power tool comprises a housing with a motor within the housing. The motor is coupled with an output. An activation member is coupled with a power source which, in turn, is coupled with the motor. The activation member is activated which, in turn, energizes the motor to drive the output. A leveling mechanism is coupled with the housing. The leveling mechanism comprises a housing with a cavity in the housing. A rotating member is positioned within the housing. The rotating member moves in the cavity such that the rotating member seeks an equilibrium position which corresponds to a horizontal or vertical plane. Electrical contacts are coupled with the rotating member such that the electrical contacts only complete an electrical circuit when the rotating member is in the equilibrium position. An indicator is electrically coupled with the electrical contacts to indicate to the user when the mechanism is in an equilibrium position. A power source is electrically coupled with the electrical contacts and the indicator to energize the indicator when the circuit is complete. The rotating member may be fixed for rotation about a central axis in a cylindrical cavity in the housing. Here, the rotating member includes a biased electrical contact. The electrical contacts include a pair of annular members coupled with the housing. Each annular member includes electrical contact portions spaced ninety (90°) degrees from one another. Thus, as the rotating member reaches the equilibrium position, the rotating member's biased electrical member contacts the annular ring electrical contact portions to complete the circuit and activate the indicator. Alternatively, the rotating member could be manufactured from an electrical conductive material. Here, the rotating member is cylindrical and has at least one projecting member. The electrical contacts include a biased member to electrically contact the at least one projecting member when the cylindrical rotating member is in the equilibrium position. An axle projects through the cylindrical rotating member to complete the circuit. Alternatively, the cavity may be defined by a pair of opposing conductive conical members acting as the electrical contacts. Here, the rotating member includes a pair of conductive balls. The opposing conductive cylindrical members are separated by a non-conductive membrane. The membrane includes apertures positioned at ninety (90°) degrees apart from one another about a circle. The balls contact one another through the apertures in the membrane when the balls are in the equilibrium position to complete the circuit and activate the indicator.

Additional objects and advantages of the present invention will become apparent from the detailed description of the preferred embodiment, and the appended claims and accompanying drawings, or may be learned by practice of the invention.

DETAILED DESCRIPTION OF THE PREFERRED EMBODIMENT

Figure 1:
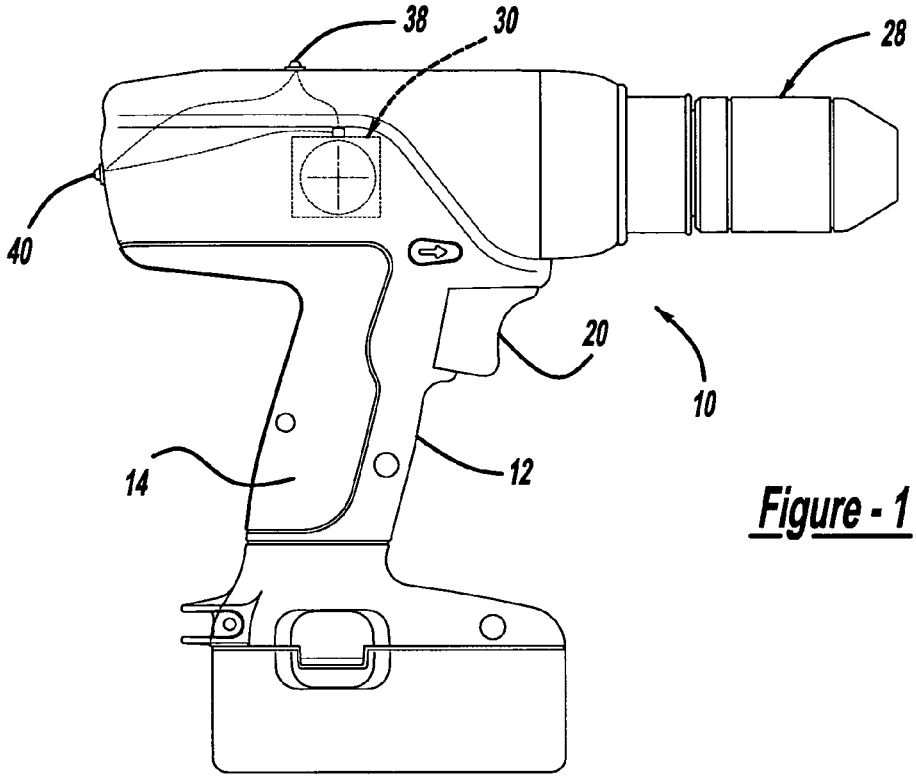
FIG. 1 is a plan view of a drill with a leveling device in accordance with the present invention.

Turning to the figures, FIG. 1 illustrates a power tool in accordance with the present invention and is designated with the reference numeral 10. The power tool 10 is illustrated as a drill; however, any type of power tool such as a screwdriver, sander, rotary tool, clippers, saw or the like can be utilized with the level indicator in accordance with the present invention. The power tool 10 includes a housing 12 which includes two halves 14 and 16, which surround a motor 18. An activation member 20 is coupled with the motor 18 as well as with a power source 22. The power source 22 may be a power cord (AC current) or the power tool may have a battery (DC current) as shown. The motor 18 is coupled with an output 24 which may include a transmission 26 and a chuck 28 to retain a tool (not shown) with the drill.

Figure 2:
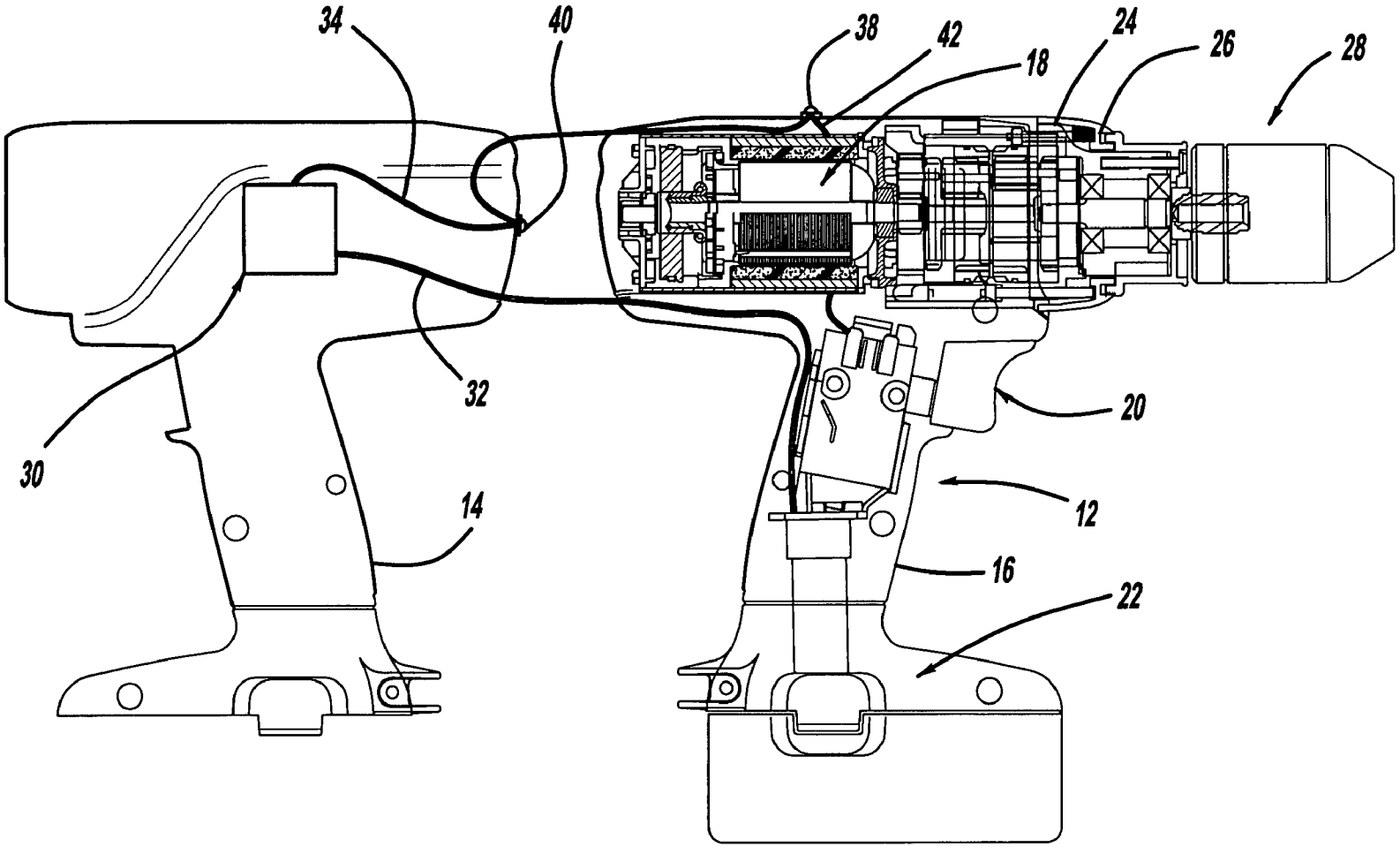
FIG. 2 illustrates a perspective view with both housing halves.

Looking at housing half 14 in FIG. 2, a level indicator is shown and designated with the reference numeral 30. The level indicator 30 has wires 32 and 34 extending therefrom. Wire 32 extends down and is coupled with the battery 22, and wire 34 extends up to indicator LEDs 38 and 40 with wire 42 leading back to the battery 22. LED 38 is positioned on top of the drill housing 12, while LED 40 is positioned at the rear of the drill. Both the indicator lights illuminate light when the drill is in a horizontal plane and vertical plane, respectively. Thus, the lights 38, 40 can be seen by the user when the drill is in several different orientations.

Figure 3:
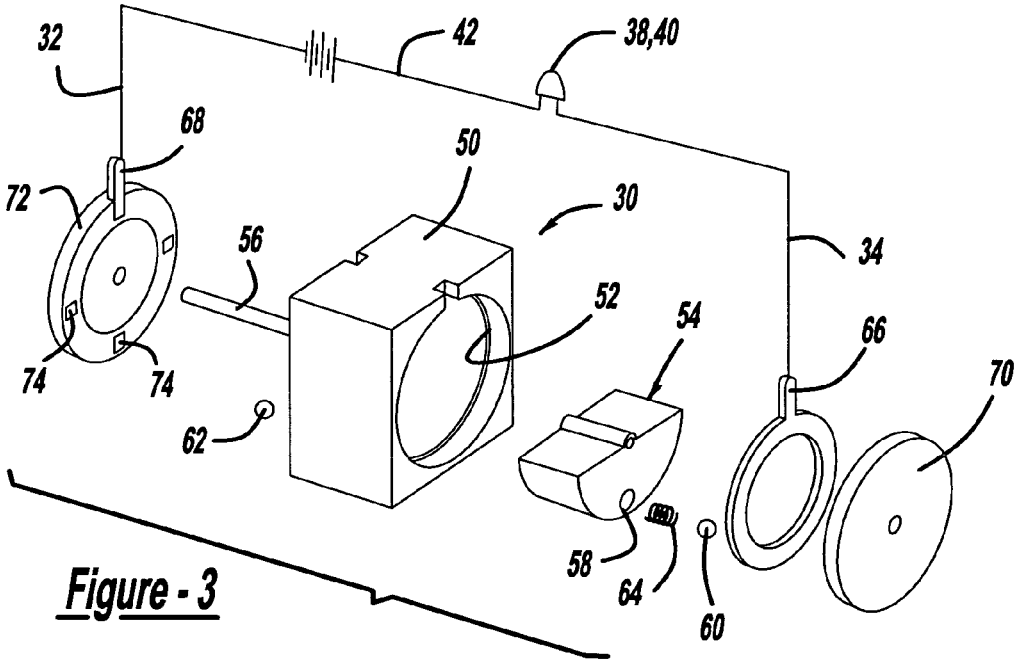
FIG. 3 is an exploded perspective view of a level indicator in accordance with the present invention.

Turning to FIG. 3, an exploded view of the level indicator 30 is shown. The level indicator 30 includes a housing 50 which defines a cylindrical cavity 52. Positioned within the cavity 52 is a rotatable pendulum member 54. The pendulum member 54 is fixed about an axle 56. Accordingly, the pendulum member 54 rotates within the cylindrical cavity 52 about the axle 56. The pendulum member 54 is weighted such that the rotating pendulum member 54 always seeks an equilibrium position. The pendulum 54 has an overall D-shape At the bottom of the curved portion, the rotating pendulum member includes a bore 58. The bore includes a pair of conductive balls 60 and 62, on each side of the rotating pendulum member 54 as well as a conductive spring 64 biasing the balls 60 and 62 away from one another.

Electrical contact rings 66 and 68 are held at the sides of the cavity 52 by non-conductive shells 70 and 72 which enclose the cavity of the housing 50. The conductive rings 66 and 68 are coated with a non-conductive material such that portions 74 of the ring are exposed for conductive purposes. The portions 74 are spaced at ninety (90°) degree intervals about the ring. Also, the rings 66 and 68 are coupled with wires 32 and 34 to complete the electrical circuit.

In use, the rotating pendulum member 54 is capable of rotating about the axle 56 in a three hundred sixty (360°) degree circle in the housing cavity 52. As the drill is manipulated, the pendulum reaches an equilibrium position. When the drill is in a horizontal or vertical plane, the conductive balls 60 and 62 in the rotated pendulum member 54 contact a conductive portion 74 on rings 66 and 68. As this occurs, the LEDs 38 and 40 are illuminated. This indicates to the user that the drill is in a horizontal or vertical plane. Thus, the user may then utilize the drill with the knowledge that it is in a horizontal or vertical plane.

Figure 4:
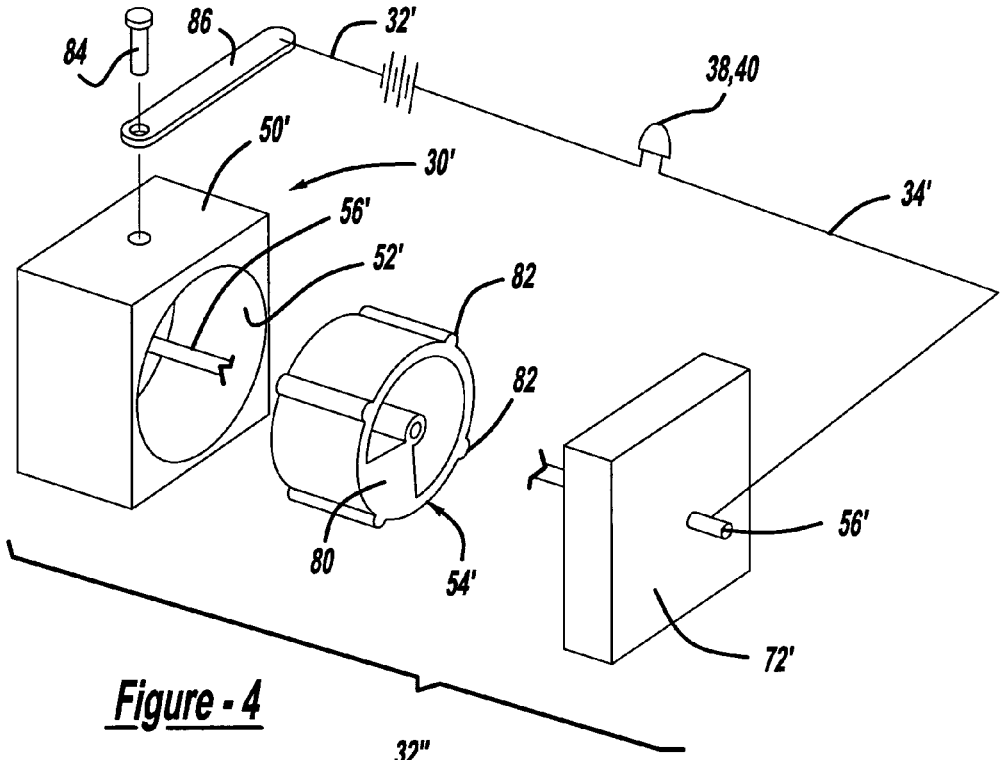
FIG. 4 is an exploded perspective view of a level indicator in accordance with the present invention.

Turning to FIG. 4, an additional embodiment of the present invention is shown. The elements that are the same are identified with the same reference numerals being primed.

The housing 50' includes a cylindrical cavity 52' for housing a rotating pendulum 54'. The pendulum 54' rotates on an axle 56'. The axle projects through a non-conductive shell 72'.

The pendulum 54' is a cylindrical body with a weighted portion 80 and external projecting members 82. The rotating pendulum member 54' is made from a conductive material. The weighting member 80 enables the rotating pendulum member 54' to seek an equilibrium position. The projecting members 82 extend from the cylindrical surface of the rotating pendulum member 54' to contact an electrical contact pin 84 in housing 50'. The contact pin 84 is coupled with a conductive leaf spring 86 which, in turn, is coupled with wire 32'. Also, the axle 56' is made from a conductive material which, in turn, has its end coupled with wire 34'.

In use, the rotating pendulum member 54' rotates about the axle 56' in a three hundred sixty (360°) degree circle. When the drill is in a horizontal or vertical plane, a projecting member 82 contacts pin 84. Axle 56', which is already coupled with wire 34', enables completion of the circuit when the projecting members 82 contact the pin 84. Thus, the circuit is complete when the rotating pendulum member 54' is in a horizontal or vertical plane. This is the only time that the projections contact the pin which, in turn, complete the circuit, illuminating LEDs 38 and 40 indicating to the user that the drill is in a desired horizontal or vertical plane.

Figure 5:
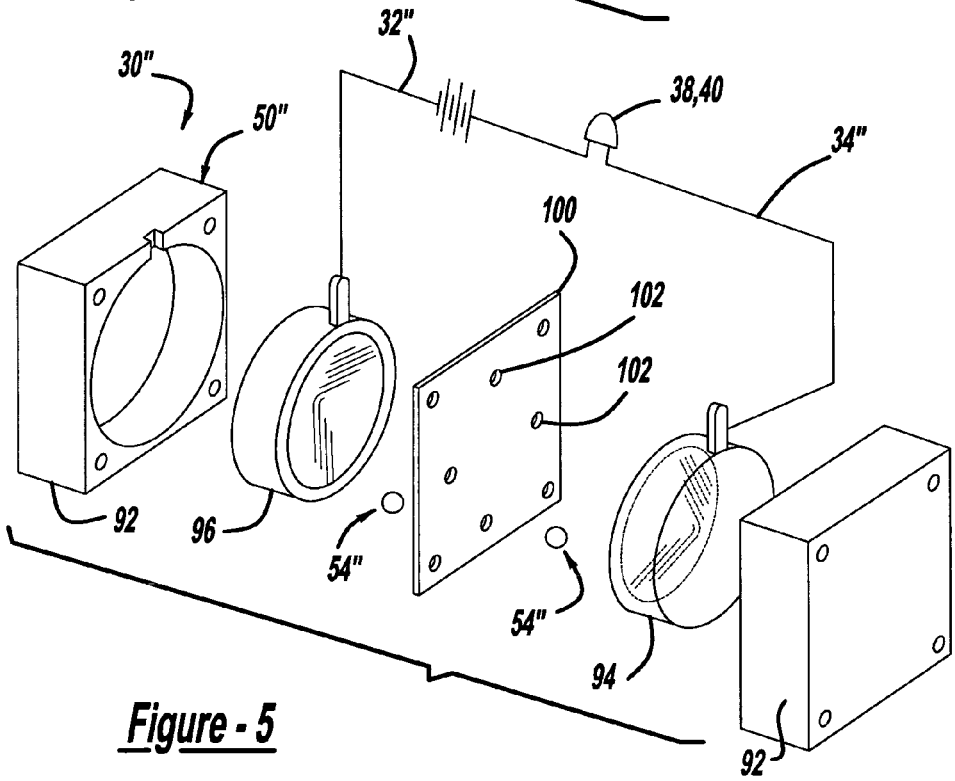
FIG. 5 is an exploded perspective view of an additional embodiment of a level indicator in accordance with the present invention.

Turning to FIG. 5, an additional embodiment of the present invention is shown. In FIG. 5, like elements will be identified with like numerals being double primed.

The leveling indicator 30" includes a housing 50". The housing includes two parts 90 and 92. Inside the non-conductive housing parts 90 and 92 are conductive cones 94 and 96. The conductive cones 94 and 96 are connected with wires 32" and 34" which, in turn, lead to the LEDs 38 and 40 as well as to battery 22". The rotating members 54" include a pair of conductive balls. A membrane 100 is positioned between the cones 94 and 96. The membrane 100 includes apertures 102 which are positioned about an arc circle, ninety (90°) degrees apart.

When the level indicator 30" is utilized, the balls 54" rotate around the cones 94 and 96. The balls 54" seek an equilibrium position at the bottom of the cones when the drill is in a horizontal or vertical plane. When the drill is in a horizontal or vertical plane, the balls 54" are positioned in the cone wherein the balls, through apertures 102, contact one another. When the balls 54" contact one another, the conductive balls 54" are also in contact with the conductive cones 94 and 96, which complete the circuit, illuminating the LEDs 38 and 40. Thus, when the level indicator is in a horizontal or vertical position, the balls 54" contact one another through the apertures 102 in the membrane and complete the circuit.

While the above detailed description describes the preferred embodiment of the present invention, the invention is susceptible to modification, variation, and alteration without deviating from the scope and fair meaning of the subjoined claims.

What is claimed is:

1. A power tool comprising:

a power tool housing;

a motor within said housing;

an output coupled with said motor;

an activation member for energizing said motor for rotating said output;

a power source electrically coupled with said motor and said activation member; and a leveling mechanism comprising a light emitting device coupled with said power tool housing and said power source, said leveling mechanism positioned inside said power tool housing near said motor such that said power tool housing surrounds said leveling mechanism, said leveling mechanism including a rotating member fixed for rotation about a central axis for seeking an equilibrium position which corresponds to a horizontal or vertical plane, and said light emitting device projecting from said power tool housing at a desired position on said power tool housing so that said light emitting device illuminates, in response to said rotating member equilibrium position, to indicate to a user that the power tool is in a horizontal or vertical position.

2. The power tool according to claim 1, said leveling mechanism further comprising:

said housing coupled within an inside surface of said power tool housing;

a cavity in said housing;

said rotating member in said housing, said rotating member moving in said cavity such that said rotating seeks an equilibrium position which corresponds to a horizontal or vertical plane;

electrical contacts in contact with said rotating member, said electrical contacts only completing an electrical circuit when said rotating member is in said equilibrium position;

said light emitting device electrically coupled with said electrical contacts; and said power source coupled with said electrical contacts for illuminating said light emitting device when the circuit is complete.

3. The power tool according to claim 2, wherein said rotating member being fixed for rotation about a center axis in a cylindrical cavity in said housing.

4. The power tool according to claim 3, wherein said rotating member includes a biased electrical contact.

5. The power tool according to claim 3, wherein said electrical contacts being a pair of annular members coupled with said housing, each said annular member including electrical contact portions spaced ninety (90°) degrees from one another about a circle such that as said rotating member reaches said equilibrium position, said rotating member biased electrical member contacts said annular rings electrical contact portions completing the circuit and activating said indicator.

6. The power tool according to claim 3, wherein rotating member being manufactured from an electrically conducting material.

7. The power tool according to claim 6, wherein said rotating member being cylindrical with at least one projecting member.

8. The power tool according to claim 7, said electrical contacts including a biased member for electrically contacting said at least one projecting member when said cylindrical rotating member is in said equilibrium position and an axle at the center axis of said rotating member completing the circuit.

9. A power tool comprising:

a power tool housing;

a motor within said housing;

an output coupled with said motor;

an activation member for energizing said motor for rotating said output;

a power source electrically coupled with said motor and said activation member; and a leveling mechanism comprising a light emitting device coupled with said power tool housing and said power source, said leveling mechanism positioned inside said power tool housing near said motor such that said power tool housing surrounds said leveling mechanism, said leveling mechanism including:

a housing coupled within an inside surface of said power tool housing;

a cavity in said housing;

a rotating member;

said rotating member in said housing, said rotating member moving in said cavity such that said rotating member seeks an equilibrium position which corresponds to a horizontal or vertical plane;

a pair of opposing conductive conical members defining said cavity acting as electrical contacts, said electrical contacts in contact with said rotating member, said electrical contacts only completing an electrical circuit when said rotating member is in said equilibrium position;

said light emitting device electrically coupled with said electrical contacts; and said power source coupled with said electrical contacts for illuminating said light emitting device when the circuit is complete; and said light emitting device projecting from said power tool housing at a desired position on said power tool housing so that said light emitting device illuminates, in response to said rotating member equilibrium position, to indicate to a user that the power tool is in a horizontal or vertical position.

10. The power tool according to claim 9, said rotating member comprising a pair of conductive balls.

11. The power tool according to claim 9, said opposing conductive conical members separated by a non-conductive membrane.

12. The power tool according to claim 9, wherein said membrane includes apertures positioned 90°, about a circle, apart from one another.

13. The power tool according to claim 9, wherein said balls contacts one another through said apertures when said balls are in said equilibrium position completing the circuit and activating said indication.

* * * * *

UNITED STATES PATENT AND TRADEMARK OFFICE

CERTIFICATE OF CORRECTION

PATENT NO. : 7,154,406 B1
APPLICATION NO. : 09/636272
DATED : December 26, 2006
INVENTOR(S) : Alfred H. Judge It is certified that error appears in the above-identified patent and that said Letters Patent is hereby corrected as shown below:

Column 5,
Line 38, after "rotating" insert -- member --.

Signed and Sealed this

Twenty-eighth Day of August, 2007

JON W. DUDAS
*Director of the United States Patent and Trademark Office*